US006928984B1

(12) United States Patent
Shamine et al.

(10) Patent No.: US 6,928,984 B1
(45) Date of Patent: Aug. 16, 2005

(54) HIGH PRESSURE LINE CONNECTION STRATEGY AND FUEL SYSTEM USING SAME

(75) Inventors: David M. Shamine, Lafayette, IN (US); Albrecht M. Ritter, Lafayette, IN (US)

(73) Assignee: Caterpillar Inc., Peoria, IL (US)

( * ) Notice: Subject to any disclaimer, the term of this patent is extended or adjusted under 35 U.S.C. 154(b) by 10 days.

(21) Appl. No.: 10/769,076

(22) Filed: Jan. 30, 2004

(51) Int. Cl.[7] ..... F02M 55/00
(52) U.S. Cl. ..... 123/456; 123/468
(58) Field of Search ..... 123/456, 468, 123/469, 470

(56) References Cited

U.S. PATENT DOCUMENTS

| | | | | |
|---|---|---|---|---|
| 5,511,527 A | * | 4/1996 | Lorraine et al. | 123/456 |
| 6,273,123 B1 | * | 8/2001 | Keefer et al. | 137/351 |
| 6,672,287 B2 | * | 1/2004 | Wada et al. | 123/468 |
| 6,732,711 B2 | * | 5/2004 | Yanagii | 123/469 |

OTHER PUBLICATIONS

Detroit Diesel Series 4000, DaimlerChrysler Powersystems, 2002, 19 pages, Detroit Diesel Corporation, Detroit, Michigan, US.

MTU Series 8000, DaimlerChrysler Powersystems Off Highway, 35 pages, Detroit Diesel Corporation, Detroit, Michigan, US.

Detroit Disesel Technician Guide, Series 4000 Common Rail Fuel System, 135 pages, Detroit Diesel Corporation, 2001, Detroit, Michigan, US.

* cited by examiner

*Primary Examiner*—Thomas Moulis
(74) *Attorney, Agent, or Firm*—Liell & McNeil

(57) ABSTRACT

High pressure fluid systems, such as those found in common rail fuel systems for engines, often need a low pressure containment system to appropriately address the possibility of fuel leakage around the engine. In addition, such high pressure systems also often require flow to go from one location, such as the common rail, to another location, such as a fuel injector, while undergoing a direction change because of spacial constraints around the engine. The present invention utilizes an elbow component with valve surfaces on its two faces that are oriented at about 90° with respect to one another. When the elbow component is fastened to the head with first fasteners and fastened to a flow limiter housing in another direction with second fasteners, a quill tube is compressed between the valve surface on the elbow component and a similar conical seat on a fuel injector in one direction while also compressing a short tube and flow limiter between the other valve surface of the elbow component and the common rail. The low pressure containment system is sealed with O-rings. The high pressure connection can be serviced without dismantling other engine components.

20 Claims, 7 Drawing Sheets

HIGH PRESSURE LINE CONNECTION STRATEGY AND FUEL SYSTEM USING SAME

DESCRIPTION

1. Technical Field

The present invention relates generally to a strategy and structure for connecting high pressure fluid lines, and more particularly to high pressure fuel connections in a fuel system for an engine.

2. Background

There are many fluid systems in existence that require transfer of high pressure fluid from one location to another location via passageways that include connections and fluid direction changes. For instance, in the case of common rail fuel systems for engines, high pressure fuel is transferred from a high pressure common rail at one location adjacent the engine to fuel injectors positioned in the engine. Because of the flammability of the fuel at the high pressures involved, some jurisdictions require that the high pressure fuel lines be contained within a low pressure containment system so that any leakage can be safely returned to tank rather than be sprayed on or near the engine. While such contained high pressure fluid systems are known in the art, it is open problematic to provide such a system that is easily serviceable and requires the dismantling of a minimum number of components associated with the engine.

For instance, the Technician Guide for the Detroit Diesel Series 4000 common rail fuel system shows the use of a somewhat serpentine shaped double walled tubing structure and associated connectors extending from its common rail to the individual fuel injectors. In part because of the irregular shape of the fluid line extending between the common rail and fuel injectors, the Detroit Diesel system must employ relatively expensive components that are at risk for misconnection, which can lead to leakage and other undesirable failures. In addition, servicing the Detroit Diesel system can be somewhat problematic, as an excess of components must be dismantled in order to gain full access to the high pressure lines for servicing and maintenance. Excessive disassembly and reassembling of various engine related components in order to service and/or inspect the engine's fuel system can drive up the cost of maintaining the engine while also increasing the risk that disassembly during the maintenance procedure could introduce new costly and time consuming repair efforts.

The present invention is directed to overcoming one or more of the problems set forth above.

SUMMARY OF THE INVENTION

In one aspect, a high pressure fluid system includes an elbow component with a first valve surface oriented at an angle with respect to a second valve surface. A high pressure passage is disposed in the elbow component, and it opens through the first valve surface and opens through the second valve surface. A low pressure passage extends from the first valve surface to the second valve surface. The elbow component includes a first flange with at least one fastener bearing surface located adjacent the first valve surface. The elbow component also includes a second flange with at least one fastener bearing surface located adjacent the second valve surface.

In another aspect, a method of assembling a high pressure fuel system for an engine includes a step of positioning a first tube in an engine head and a second tube adjacent a common rail. The first tube is compressed between an elbow component and a fuel injector, and the second tube is compressed between the common rail and the elbow component.

DETAILED DESCRIPTION

Figure 1:
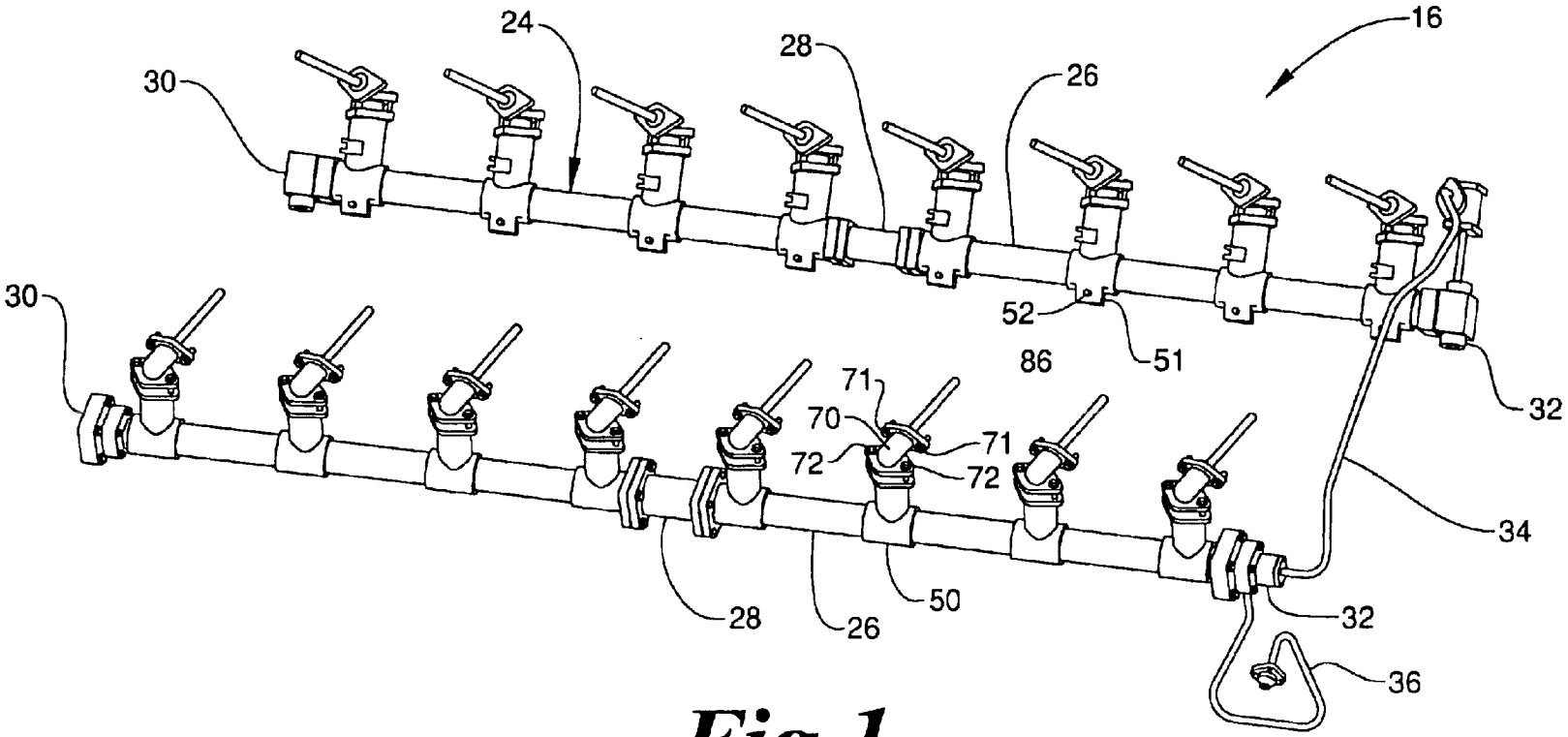
FIG. 1 is a diagrammatic isometric view of a common rail fuel system for a sixteen cylinder V-type engine according to one aspect of the present invention.
Figure 2:
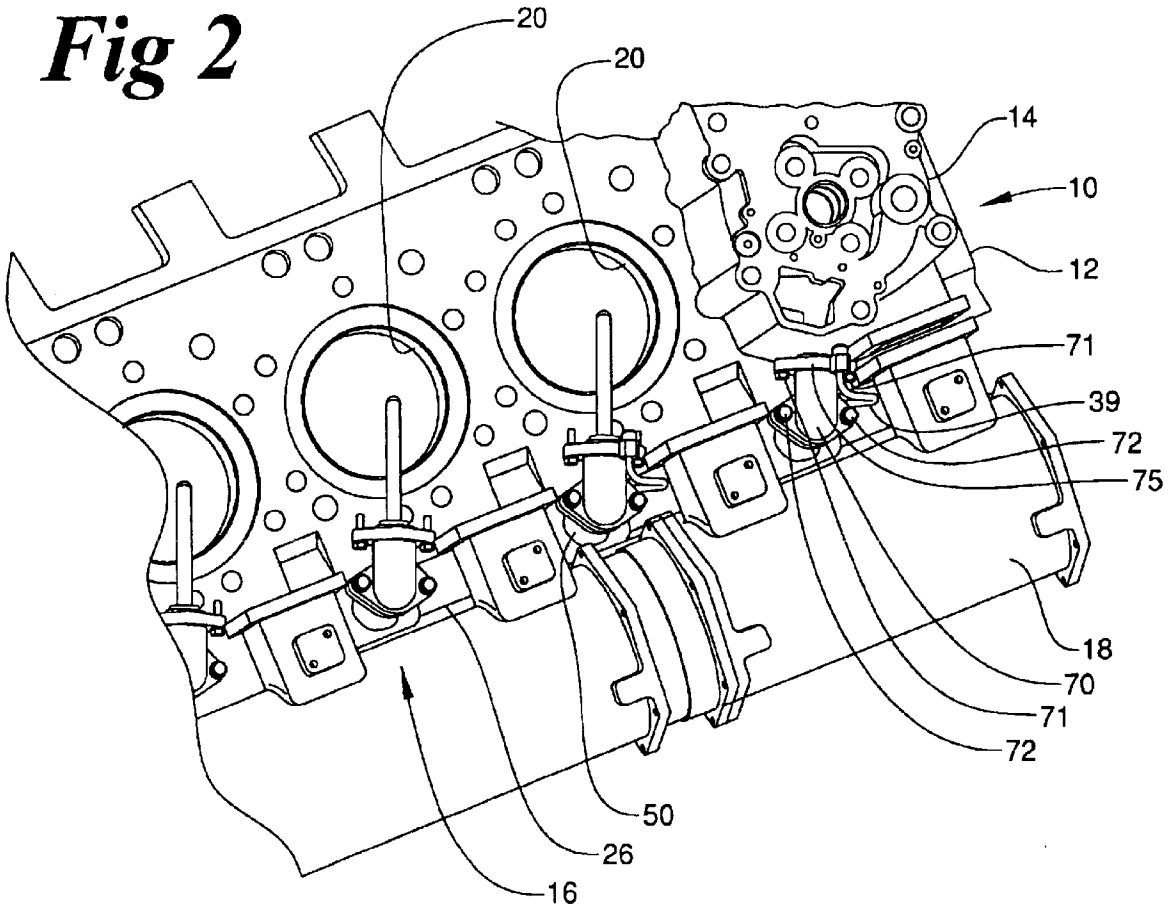
FIG. 2 is a diagrammatic top isometric view of a portion of an engine with the fuel system of FIG. 1 installed.

Referring initially to FIGS. 1 and 2, an engine 10 includes a block 12 and, in the illustrated example, a separate head 14 for each cylinder 20. In the illustrated example, engine 10 is a V-type compression ignition engine with sixteen cylinders used in various applications, such as a marine propulsion system. Although the present invention is illustrated in the context of a common rail fuel system for a direct injection compression ignition engine, those skilled in the art will appreciate that the present invention could find application to other engine fuel systems, including but not limited to spark ignited engines, plumbing associated with hydraulically actuated fuel injection systems, and possibly to high pressure lines associated with a pump-and-line fuel system. The engine 10 includes a common rail fuel system 16 and a gas exchange system 18 attached on the outside of engine 10. In the illustrated embodiment, it is the intake portion of the gas exchange system that is mounted outside the engine adjacent to fuel system 16. Nevertheless, those skilled in the art will appreciate that the intake and/or exhaust system for the engine could be located in close proximity to the common rail fuel system 16 in other engines without departing from the intending scope of the present invention.

Fuel system 16 includes a pair of common rails 22 and 24 that are respectively mounted on the left and right hand sides of engine 10. Each of the common rails 22 and 24 includes a pair of substantially identical rail segments 26 joined by a modular connection 28. Those skilled in the art will appreciate that the modular components of the fuel system 16 allow for their being assembled in a different number and pattern for an engine (not shown) having a different number of cylinders. This aspect of the fuel system 16 allows for various components to be used in different numbers and arrangements for a plurality of different engines in a line of engines. In other words, rail segments 26 could make up the core of a fuel system for an eight cylinder engine (not shown).

Figure 3:
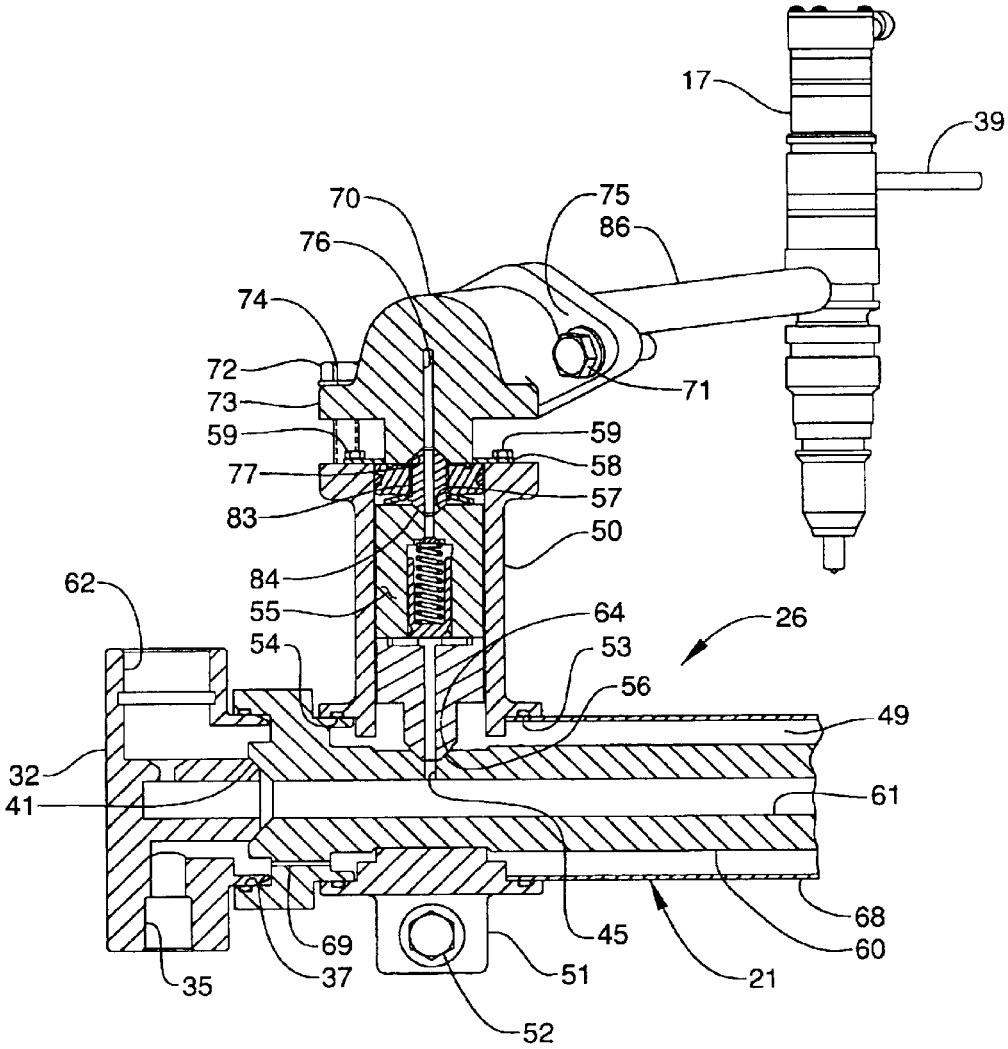
FIG. 3 is a sectioned front diagrammatic view of one end of the fuel system of FIG. 1.
Figure 4:
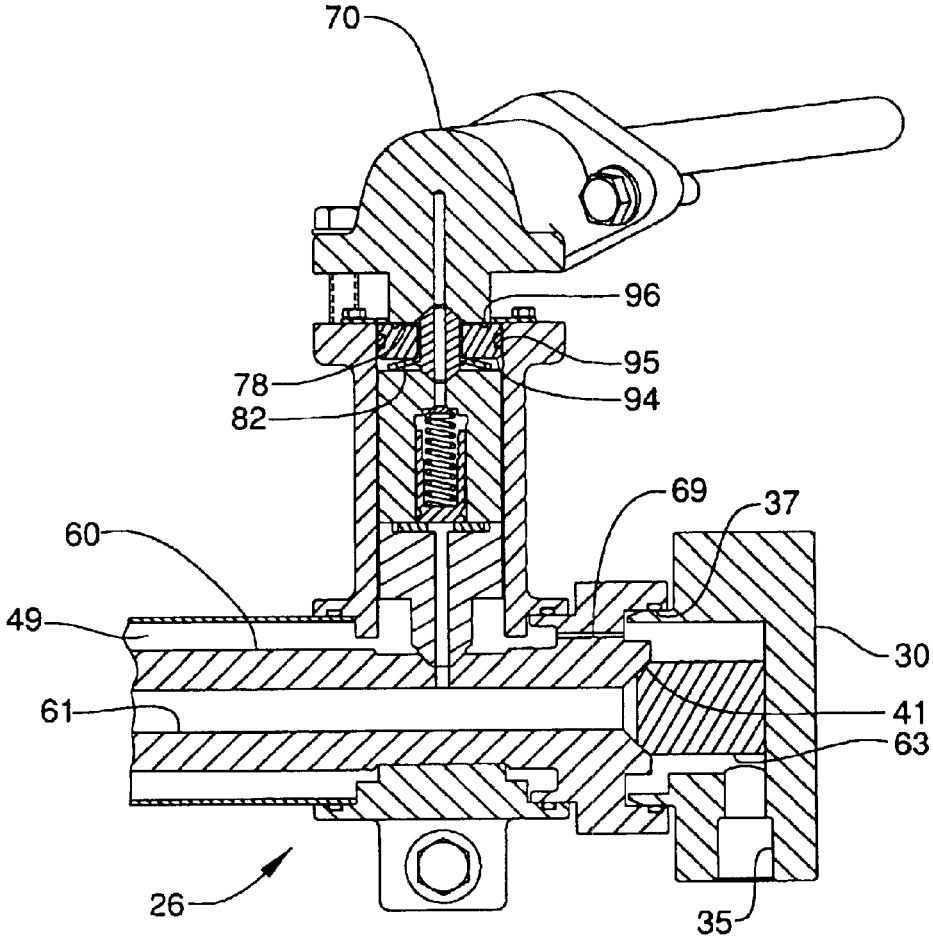
FIG. 4 is a front sectioned diagrammatic view of an opposite end of the fuel system of FIG. 1.
Figure 5:
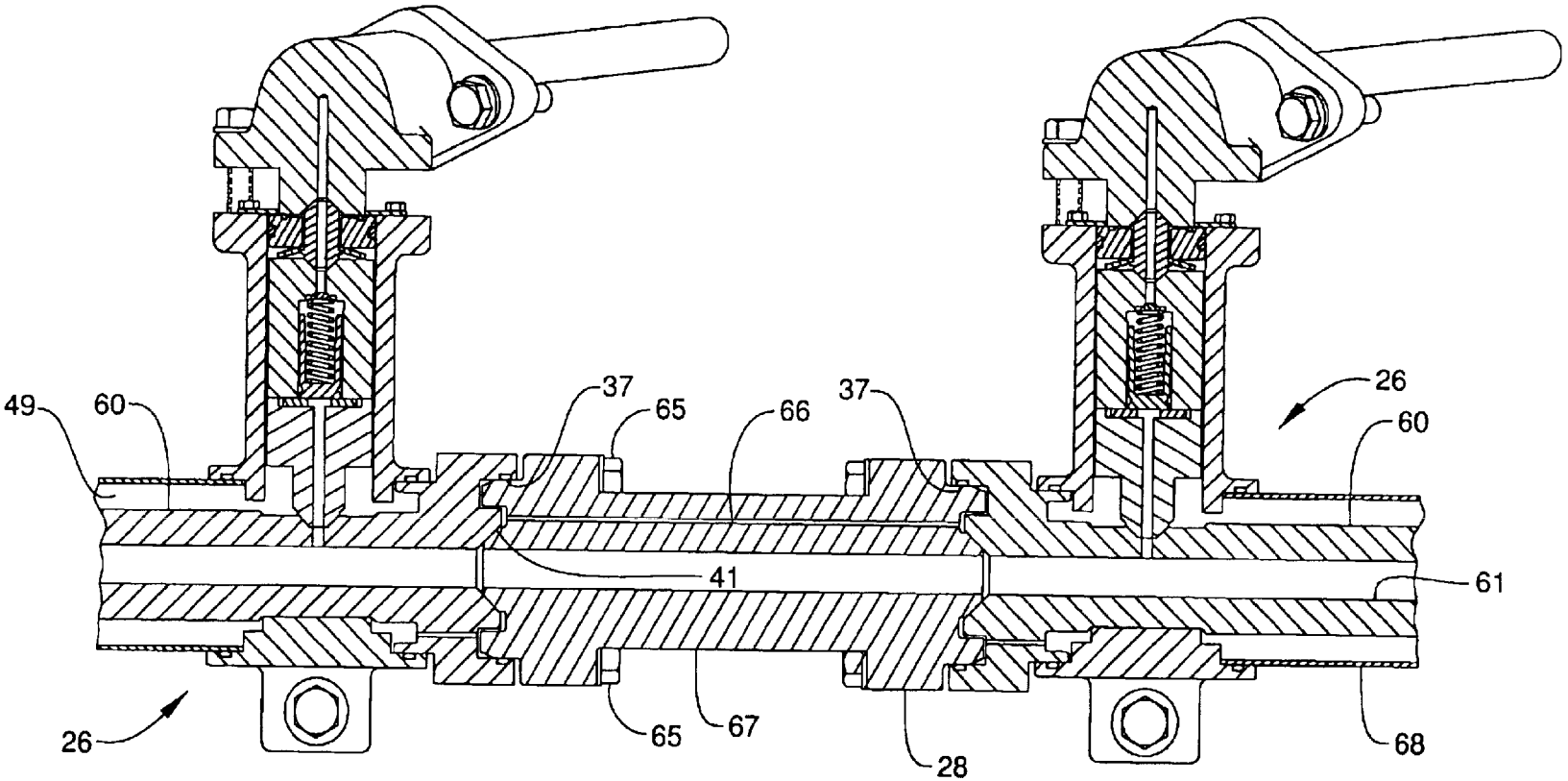
FIG. 5 is a sectioned front diagrammatic view of a mid point in the fuel injection system of FIG. 1.

Common rails 22 and 24 are supplied with high pressure fuel from a pump (not shown) in a conventional manner. In other words, a high pressure pump(s) supplies high pressure fuel to common rail 22 via a high pressure supply line 36. A portion of this fuel is communicated to the other common rail 24 via a rail communication line 34. Referring in addition to FIGS. 3–5, each end of the respective common rails 22 and 24 is capped with a first end cap 30 at one end and a second rail end cap 32 at its opposite end. Each of the first and second end caps 30 and 32 include a drain port 35 that is fluidly connected to a low pressure containment reservoir or to the low pressure tank via low pressure gravity flow lines (not shown). A plug 63 contained in first rail end caps 30 closes and seals one end of an internal high pressure rail to segment 60 as shown in FIG. 4. O-rings 37 seal the low pressure containment connection surrounding the high pressure rail segments 60 from the atmosphere. Fasteners bearing on rail end cap 30 that are threaded into one end of rail tube segment 60 hold plug 63 seated on a conical valve seat 41 at the end of segment 60. Second rail end caps 32, on the other hand, include a high pressure inlet 62 that are fluidly connected to high pressure lines 34 and 36, respectively. In the preferred embodiment, low pressure drain port 35 is located at each end of each of the common rails 22 and 24 so that any leaked fuel will find its way to one of the drains regardless of whether the engine is oriented horizontally or at some angle. A pair of rail tube segments 60 are joined as shown in FIG. 5 with a modular connection 28 that includes an internal rail tube 67, which includes a spherical end surfaces that are seated in respective conical seats of two adjacent rail segments 60 as shown in FIG. 5. The rail tube 67 is surrounded by an outer housing that is attached in opposite directions to rail segments 60 with fasteners 65 so that the spherical ends of rail tube 67 seat in the conical seats of the rail segments 60 to make a fluid tight seal. The space between the outer housing and the inner rail tube 67 acts as a low pressure leak passage 66 to fluidly connect the low pressure containment volume surrounding the adjacent rail segments 60. A pair of O-rings 37 at opposites ends of the module connection 28 seal the low pressure containment aspect of the fuel system from the atmosphere.

Each of the rail tube segments 60 includes a plurality of side ports that each include a conical seat 64. There being one side port for each of the fuel injectors 17. A separate low pressure injector return line 39 is fluidly connected at one end (not shown) to the low pressure return port (not shown) of the individual fuel injectors 17 and at its other end (not shown) to a connection block that eventually leads to the low pressure tank (not shown). Those skilled in the art will appreciate that many fuel injectors 17 consume some high pressure fuel in order to perform a control function, such as directly controlling a nozzle valve. This low pressure returned fuel is preferably in a low pressure return line system (37 and other portions not shown) that is separate from the low pressure leak containment system that surrounds the high pressure passages 60, 45, 76, 88 associated with fuel system 16. In the illustrated embodiment, a portion of the low pressure return line 39 is located within the head 14, which surrounds a low pressure port on fuel injector 17. Thus, the external portion of the low pressure return line 39 is connected at one end to a port 42 on head 14 as shown in FIG. 2, and on its other end to a low pressure return rail (not shown) that may be located adjacent, but underneath, respective common rails 22 and 24, or at any other suitable location with respect to engine 10.

Figure 6:
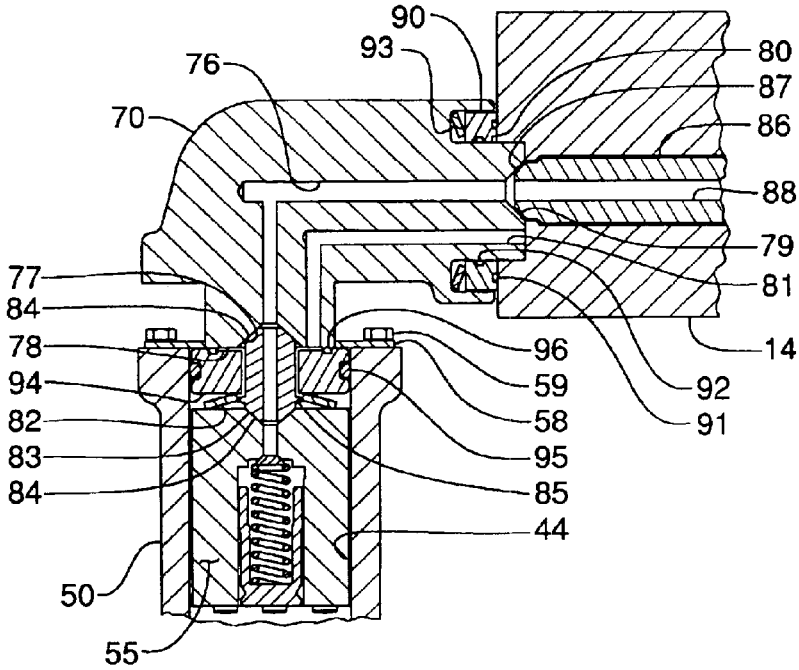
FIG. 6 is a partial sectioned diagrammatic side view of one rail-to-injector fluid connection for the fuel system of FIG. 1.

Referring specifically to FIG. 3, the high pressure fluid line extending between each fuel injector 17 and its respective rail segment 60 includes a flow limiter 55, a short tube 83, an elbow component 70 and a quill tube 86. Flow limiter 55 includes an internal structure well known in the art that is separated at one end from a spherical valve surface 56 and at its other end by a conical seat 57. Short tube 83 includes substantially identical spherical valve surfaces 84 at its opposite ends. Elbow component 70 includes an internal high pressure passage 76 that opens at one end through a first conical seat 77, and opens its other end opens through a second conical seat 79, as shown in FIG. 6. Thus, each connection interface includes a spherical valve surface bearing against, and seated in, a conical seat. Those skilled in the art will appreciate that, which component includes the spherical valve surface and which component includes the conical seat can be different from the structure in the illustrated embodiment. When the connections are properly assembled, each pair of a conical seat and spherical valve surface are compressed together to form a fluid tight seal at that high pressure connection.

All of the high pressure fluid connections (e.g. 87–79, 84–77, 84–57, 56–64) in fuel system 16 are enclosed by a low pressure leak return path that empties into one or more of the leak ports 35 as shown in FIGS. 3 and 4. Each of the rail tube segments 60 is enclosed by a plurality of flow limiter housings 50 that are each separated by a thin walled cylinder 68. The low pressure volume 49 between the outer surface of rail tube segment 60 and the inner surface of flow limiter housing 50 and thin walled cylinder 68 constitute portions of the low pressure containment path that is fluidly connected to drain ports 35 via leak connection passages 69. The low pressure volume is sealed with respect to end cap 32 by an O-ring 37, and sealed with respect to flow limiter housing 50 via O-rings 53 and 54 as shown in FIG. 3. Each flow limiter housing 50 is substantially identical and includes a flange 51 through which a fastener 52 attaches the flow limiter housing 50 to the engine block 12. The upper end of each flow limiter housing 50 includes a flange with threaded bores that receive fasteners 72 that pass through a flange 73 in elbow component 70 and bear against fastener surfaces 74. In other words, when fasteners 72 are threaded into flow limiter housing 50, short tube 83 and flow limiter 55 are compressed between conical seat 64 and rail segment 60 and conical seat 77 on elbow component 70. Thus, the torques applied to fasteners 72 are directly related to the seating force of short tube 83 and flow limiter 55 on their respective conical seats 77 and 64. In addition, this compressive force acts on the centerline of these components (83, 55, 70), thus allowing the flow direction change to occur within elbow component 70 rather than with some irregularly shaped tube as in the prior art.

In the event that a leak should develop at the interface between an of the conical seats (e.g. 79, 77, 57, 45) and the spherical valve surfaces (e.g. 87, 84, 56), that leak is contained within the low pressure system 21 which is sealed at one end with an O-ring 96 that bears against a sealing face 78 of elbow component 70. The low pressure segment associated with elbow 70 extends between valve surfaces 77 and 79, immediately adjacent the high pressure seal. Those skilled in the art will appreciate that sealing face 78 surrounds conical seat 77. O-ring 96 is carried by a carrier seal ring 94 that includes an O-ring 95 that bears against an inner annular surface of flow limiter 50. Thus, if a leak should occur somewhere around conical seat 77, that fuel will flow down along the outer surface of short tube 83, through carrier ring 94 and along a low pressure passage 44 between the outer surface of flow limiter 55 and housing 50, then down into the low pressure volume 49 between the outer surface of rail segment 60 and thin walled cylinder 68, eventually into drain port 35. Seal carrier ring 94 is urged upward toward annular face seal 78 by a spring 82, which is preferably one or more Belleville spring washers. Seal carrier ring 94 is preferably maintained within flow limiter housing 50 via a retainer plate 58 that is held in place against the top edge of housing 50 via fasteners 59. In turn, short tube 83 preferably includes an annular ridge 85 with a diameter larger than the inner diameter of the hole through seal carrier ring 94 so that a sub assembly of the housing 50, flow limiter 55, short tube 83, spring 82 and carrier ring 94 can all be held together as a sub-assembly without risk that the smaller components (e.i. tube 83) will fall free during servicing or assembly. Thus, if and when elbow component 70 is unfastened from housing 50, the smaller components held within housing 50 are maintained in position without having the opportunity to come loose and become possibly misplaced.

Those skilled in the art will appreciate that the conical seat 77 is oriented at an angle that is greater than zero but less than 180° with respect to conical seat 79. In the preferred illustrated embodiment, this angle is about 90° to facilitate a 90° change in the direction of fluid flow in high pressure passage 76. Surrounding an annular sealing surface 80, which encircles conical seat 79, is a second seal carrier ring 90 that includes an O-ring seal 92 that bears against sealing surface 80. Seal carrier ring 90 also includes a second O-ring 91 that seals against an annular sealing face on head 14 that surrounds quill tube 86. O-ring 91 is urged into contact with head 14 via a spring 93, which is preferably one or more Belleville washers.

Figure 7:
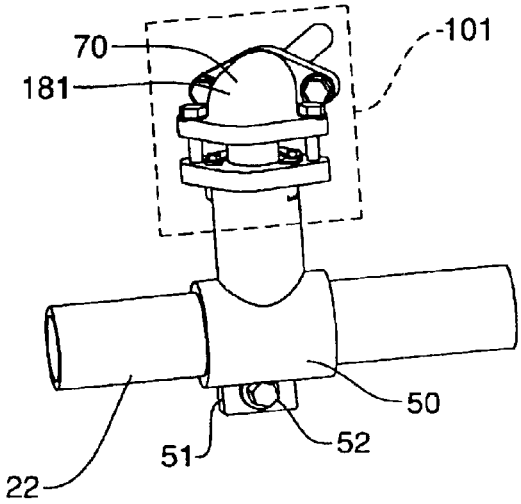
FIG. 7 is a diagrammatic front partial view of a rail-to-injector connection of the fuel system of FIG. 1, which also includes a feature according to another aspect of the present invention.

Quill tube 86 includes substantially identical spherical valve surfaces 87 on its opposite ends that are compressed between conical seat 79 on elbow component 70 and a similar conical seat (not shown) at the high pressure inlet of fuel injector 17. Any leakage that might occur at either high pressure connection is contained in head 14 and sealed to prevent leakage to the other surface of the engine by O-rings 91 and 92. If leakage should occur, that leakage can be transmitted back into flow limiter housing 50 and then into drain ports 35 (FIGS. 3 and 4) via a low pressure passage 81 that is defined by, or disposed in, elbow component 70. Thus, the only portion of the high pressure supply to the individual fuel injectors 17 that is not entirely enclosed by a low pressure volume is the high pressure passage 76 through elbow component 70. However, since leakage almost always occurs at a fluid connection, which are enclosed by a low pressure containment volume 49, the inclusion of low pressure passage 81 through elbow component 70 is preferred. Nevertheless, FIG. 7 shows an alternative version in which a clam shell housing 101 encloses elbow component 70, and the low pressure passage 181 from the area around quill tube 86 is defined by an inner surface of clam shell 181 and the outer surface of elbow component 70. Such an alternative use of the clam shell enclosure 101 may be desirable in those instances where a jurisdictional issue requires double walling of all high pressure spaces in the fuel system rather than all high pressure connections as in the illustrated embodiment. Such an alternative could facilitate possible elimination of O-ring carriers 94 and 90 in place of seals between the clam shell 101 and the outer surface of head 14 and flow limiter housing 50. In any event, when fasteners 71, (as best shown in FIG. 2) are threaded into head 14, quill tube 86 is compressed between conical seat 79 on elbow component 70 and another conical seat (not shown) on fuel injector 17.

INDUSTRIAL APPLICABILITY

The contained high pressure connection strategy described above between the respective common rails 22, 24 and the individual fuel injectors 17 could find potential application outside of common rail fuel systems 16. In fact, the present disclosure could find potential application in any contained high pressure fluid system where there is a need to change fluid flow direction, and do so in a way that renders all components easily accessible while retaining a robust high pressure connection. The present disclosure is also especially applicable in those cases, such as a common rail fuel system 16, where one could expect there to be movement between the respective components that make up the high pressure connections (e.g., 87–79, 84–77, 84–57, 56–64). The spherical/conical seats allow for more relaxed tolerances when aligning the lines during assembly to take up any tolerance stack up. In other words, it is this aspect of the disclosure that allows for substantial loosening of geometrical tolerances when establishing fastener bores and the like with regard to the common rails 22,24, engine head 14, fuel injectors 17 and the like. Those skilled in the art will appreciate that which of two touching components includes the spherical valve surface and which includes a conical valve seat with regard to the present invention is generally a matter of ease of manufacture and other similar concerns known in the art.

Apart from being robust and less sensitive to geometrical tolerancing, the present disclosure also provides an easily serviceable structure. Those skilled in the art recognize that rare occurrences of leakage are almost inevitable, and hence the need to access the various components (e.g., 55,83,56) that make up the high pressure fuel system 16 is a must. Given this fact, the present structure accomplishes accessibility without requiring dismantlement of other engine components in order to gain access to the high pressure fuel system 16 components extending between the common rail 22,24 and the individual fuel injectors 17. In particular, there are often portions of an engine gas exchange system 18 in the vicinity of the common rail fuel system 16 components. In the illustrated example, it is the intake portion of the gas exchange system 18 that could potentially hinder easy access to the high pressure connection components (e.g, 55,83,86). The elbow component 70 of the present disclosure is generally the last component of the fuel system 16 to be attached, or the first to be removed when gaining access to the high pressure components (e.g., 55,83,86).

Figure 8:
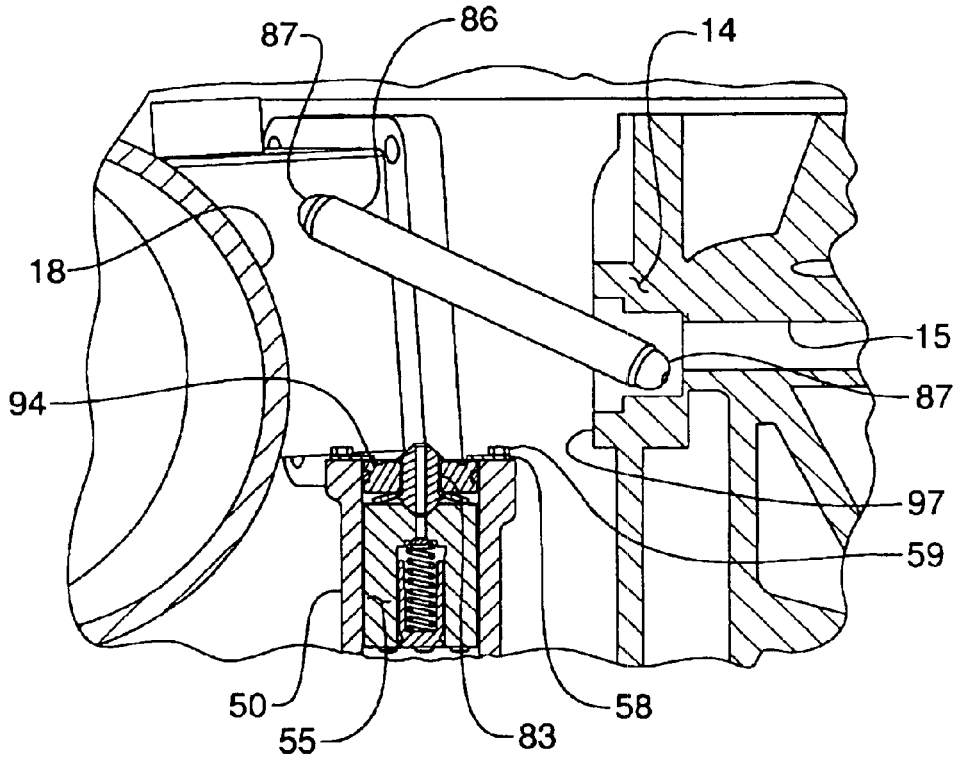
FIG. 8 is a diagrammatic partially dismantled portion of the fuel system of FIG. 1 after installation on the engine of FIG. 2.

Referring to FIGS. 1 and 2, the elbow component 70 can be removed by loosening fasteners 71 and 72. The conical seats of the elbow component 70 can then be examined for wear and replaced as necessary. FIG. 8 shows that the particular structure of the present disclosure allows for the quill tube 86 to be removed from the low pressure passage 15 in the engine head 14 after removal of the elbow component 70, without moving or otherwise disassembling any aspect of the intake portion of the gas exchange system 18. The spherical valve surfaces 87 of the quill tube 86 can be examined for wear and replaced if necessary. Also, the components (e.g., 83, 55) below the elbow components 70 are also now accessible. However, the retention plate 58 and fastener 59 prevent the short tube 83, ring seal carrier 94 or the flow limiter 55 from escaping from flow limiter housing 50. If necessary, fastener 59 and retention plate 58 can be removed allowing the short tube 83 to be examined for wear and replaced if necessary along with the O-rings 95,96 associated with the carrier ring seal 94. In addition, the entire flow limiter 55 can be pulled out of the flow limiter housing 50 and examined and replaced if necessary. Likewise, the carrier ring seal 90 associated with the engine head 14 can be easily removed and any needed O-ring 91,92 replacement can be accomplished.

The high pressure connections (56–64, 57–84, 77–84) are then reassembled in reverse order by positioning the components and attaching fastener 59 as shown in FIG. 8. Also, the Belleville washer 93 and carrier seal ring 90 can be loaded onto the elbow component 70 as shown in FIG. 6. The quill tube 86 is reinserted into low pressure passage 15 and head 14 and then the elbow component 70 is loosely positioned adjacent both quill tube 86 and short tube 83. When fasteners 71 and 72 are tightened to head 14 and flow limiter housing 50, respectively, the respective tubes 86 and 83 are compressed along their respective axes to seat the spherical valve surfaces 56,84 in their respective conical seats 64,57,77 and complete the high pressure connection.

The sealing of the low pressure containment aspect of the present disclosure does not rely upon the fasteners 71 and 72, but instead upon a predetermined spring force provided by the Belleville washers 82 and 93 (FIG. 6) to engage the respective O-ring face seals 96 and 91 with their counterpart face sealing surfaces 78 and 97 on elbow component 70 and head 14, respectively. This assembly of the system 16 can be encouraged by making at least one of the tubes 86 and 83 symmetrical with identical opposite ends so that it is irrelevant which direction the tube is inserted into the system 16. However, in the illustrated embodiment, the short tube 83 includes an annular ridge 85 that prevents it from escaping from the flow limiter housing 50 subassembly without removing a separate fastener 59.

Those skilled in the art will appreciate that the present disclosure allows for a direction change in a high pressure fluid system 16. It exploits this direction change to provide for relatively easy access and serviceability of the internal components. In addition, the present disclosure separates the high pressure sealing from the sealing associated with the low pressure containment system 21. In other words, the fasteners 71 and 72 associated with the elbow component do not directly apply pressure to the low pressure seals (O-rings 91,92,95,96), but instead act somewhat as locating surfaces to insure that the seal rings 90,94 and Belleville washers 93,82 can press against the appropriate surfaces to seal the low pressure containment system 21.

Although the present disclosure has been illustrated as including a low pressure passage 81 through the elbow component 70 to facilitate transfer of any potential leaked fluid, the present disclosure also contemplates a potential alternative. In other words, the present disclosure shows all of the high pressure connections (e.g., 56–64,57–84,77–84) being surrounded by the low pressure containment system 21. However, the high pressure passage 76 through the elbow component 70 is not double walled. In those instances where a double wall enclosing the entire high pressure line is required, a clam shell enclosure 01 such as that shown in FIG. 7 could be utilized. In such a case, it might be possible to eliminate some of the O-ring seals shown in the preferred embodiment, or relocating the same to those areas between the clam shell 01 and the outer surface of the flow limiter housing 50 and/or engine head 14 to seal the clam shell 01 around the elbow component 70. In such a case, the low pressure passage 181 communicating with the area around the quill tube 86 and the area around the short tube 83 would be a passage between the inner surface of the clam shell and the outer surface of the elbow component 70. Another potential variation utilizes fastener bores that are parallel to the respective valve surfaces on elbow component 70. In a possible alternative, it may be desirable to eliminate some of the fasteners. Instead one or more fasteners disposed at a angle that points between the short 83 and long tubes 86 to accomplish simultaneous compression of the spherical valve surfaces (e.g., 84,56,87) with the conical valve seats (e.g., 64,57,77,79). In other words, fastener bores located in the engine head or block at an angle relative to the axes of the tubes 86 and 83 could allow for simultaneous compression in both directions.

It should be understood that the above description is intended for illustrative purposes only, and is not intended to limit the scope of the present disclosure. Thus, those skilled in the art will appreciate that other aspects, and advantages can be obtained from a study of the drawings, the disclosure and the appended claims.

What is claimed is:

1. A high pressure fluid system comprising:

an elbow component having a first valve surface and a second valve surface oriented at an angle greater than zero degrees but less than 180 degrees with respect to said first valve surface;

said elbow component having a high pressure passage disposed therein, and said high pressure passage opens through said first valve surface, and opens through said second valve surface;

a low pressure passage extending between said first valve surface and said second valve surface;

said elbow component including a first flange located adjacent said first valve surface and including at least one fastener bearing surface; and said elbow component including a second flange located adjacent said second valve surface and including at least one fastener bearing surfaces.

2. The system of claim 1 including a first O-ring in contact with a first sealing surface, and a second O-ring in contact with a second sealing surface; and said first valve surface including one of a conical surface and a spherical surface enclosed by said first sealing surface; and said second valve surface including one of conical surface and a spherical surface enclosed by said second sealing surface.

3. The system of claim 1 wherein said first and second valve surfaces include conical seats.

4. The system of claim 2 including a first seal carrier ring carrying said first O-ring and a third O-ring;

a second seal carrier ring carrying said second O-ring and a fourth O-ring; and at least two of said first, second, third and fourth O-rings being face seals.

5. The system of claim 4 including a first spring in contact with said first seal carrier ring on a side opposite from a face seal surface; and a second spring in contact with said second seal carrier ring on a side opposite from a face seal surface.

6. The system of claim 1 wherein said first flange has at least two fastener bearing surfaces located in a plane perpendicular to said first valve surface; and said second flange has at least two fastener bearing surfaces located in a plane perpendicular to said second valve surface.

7. The system of claim 6 wherein each of said fastener bearing surfaces surrounds a fastener bore.

8. The system of claim 1 wherein said first valve surface includes one of a conical surface and a spherical surface;

a first tube with an other of a conical surface and a spherical surface in contact with said first valve surface;

said second valve surface includes one of conical surface and a spherical surface; and a second tube with an other of a conical surface and a spherical surface in contact with said second valve surface.

9. The system of claim 8 wherein at least one of said first tube and said second tube is symmetrical with identical spherical surfaces on opposite ends.

10. The system of claim 9 wherein said elbow component includes a first flange with at least two fastener bearing surfaces;

said elbow component includes a second flange with at least two fastener bearing surfaces;

each of said fastener bearing surfaces surrounds a fastener bore;

a first seal carrier ring carrying said first O-ring and a third O-ring;

a second seal carrier ring carrying said second O-ring and a fourth O-ring;

a first spring in contact with said first seal carrier ring on a side opposite from a face seal surface; and a second spring in contact with said second seal carrier ring on a side opposite from a face seal surface.

11. The system of claim 1 wherein said low pressure passage is one of: disposed in said elbow component, and partially defined by an outer surface of said elbow component.

12. A fuel system for an engine, comprising:

an elbow component with a first valve surface and a second valve surface oriented at an angle greater than zero degrees but less than 180 degrees with respect to said first valve surface;

said elbow component having a high pressure passage disposed therein that opens through said first valve surface, and opens through said second valve surface; and a low pressure passage extending between said first valve surface and said second valve surface.

13. The fuel system of claim 11 including a first tube compressed between said first valve surface and a fuel injector; and a second tube compressed between said second valve surface and a source of high pressure fuel.

14. The fuel system of claim 13 wherein said low pressure passage is one of: disposed in said elbow component, and partially defined by an outer surface of said elbow component.

15. The fuel system of claim 14 wherein said elbow component is attached to an engine head with first fasteners, and attached to a common rail component with second fasteners.

16. A method of assembling a high pressure fuel system for an engine, comprising the steps of:

positioning a first tube in an engine head;

positioning a second tube adjacent a common rail;

compressing the first tube between an elbow component and a fuel injector; and compressing the second tube between the common rail and the elbow component.

17. The method of claim 16 wherein the compressing steps are performed in orthogonal directions.

18. The method of claim 17 wherein the compressing steps include a step of sealing the first tube and the second tube in a low pressure passage.

19. The method of claim 18 wherein the compressing steps include a step of tightening at least one fastener.

20. The method of claim 18 including a step of avoiding misassembly at least in part by shaping at least one of the first and second tubes to be symmetrical with identical ends.

* * * * *